US007587923B1

(12) United States Patent
Garza

(10) Patent No.: US 7,587,923 B1
(45) Date of Patent: Sep. 15, 2009

(54) METHOD OF MAKING A TUBULAR

(76) Inventor: Raul Garza, 11 E. Twinvale Loop, The Woodlands, TX (US) 77384

( * ) Notice: Subject to any disclaimer, the term of this patent is extended or adjusted under 35 U.S.C. 154(b) by 508 days.

(21) Appl. No.: 11/484,142

(22) Filed: Jul. 12, 2006

(51) Int. Cl.
*B21D 3/00* (2006.01)
*B21D 41/00* (2006.01)
*B21C 37/00* (2006.01)

(52) U.S. Cl. ..... 72/367.1; 72/370.1

(58) Field of Classification Search ..... 72/367.1, 72/368, 370.1; 235/462.1, 462.16, 493–494; 148/519–521, 570, 590
See application file for complete search history.

(56) References Cited

U.S. PATENT DOCUMENTS 5,489,126 A * 2/1996 Gray, Jr. ..... 285/93
5,632,916 A * 5/1997 Lappalainen et al. ... 219/121.85
6,068,966 A * 5/2000 Koga ..... 430/322
6,544,804 B2 * 4/2003 Yano et al. ..... 438/14
2001/0040374 A1 * 11/2001 Breihan ..... 285/93
2005/0003103 A1 * 1/2005 Krupa ..... 427/558

* cited by examiner

*Primary Examiner*—Dana Ross
*Assistant Examiner*—Mohammad Yusuf
(74) *Attorney, Agent, or Firm*—Egbert Law Offices PLLC

(57) ABSTRACT

A method of marking a tubular includes the steps of applying an identification indicia onto the outer diameter of the tubular, forming an indicator onto at least one of the ends of the tubular such that the indicator corresponds to information in the identification indicia, heat treating the tubular such that the identification indicia is diminished, and reapplying the identification indicia onto the outer diameter of the tubular based upon the indicator formed on the end of the tubular. The tubular has an upset formed on at least one end thereof. The end of the tubular is machined so as to remove the indicator therefrom after the identification information is reapplied to the outer diameter of the tubular.

21 Claims, 2 Drawing Sheets

METHOD OF MAKING A TUBULAR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to the forming and manufacturing of tubulars. More particularly, the present invention relates to the manufacturing of tubular products and tubulars having an upset formed on at least one end thereof. Furthermore, the present invention relates to techniques for marking such tubulars during the manufacturing process and during the forming of the upset of the tubular.

BACKGROUND OF THE INVENTION

Metal pipe, such as drill pipe, is normally assembled by joining adjacent lengths of drill pipe. The ends of the drill pipe are normally upset for welding to a threaded tool joint for connection of adjacent pipe lengths. The drill pipe lengths prior to forming of the upset ends and threads are of a constant wall thickness and have uniform inner and outer peripheries. A conventional method of forming an upset utilizes a die mandrel to form in a forging operation an external upset portion of increased wall thickness. Then, in a separate step with another die and mandrel, the end of the pipe is pressed or squeezed inwardly to form an internal upset portion. As used herein, the term "tubular" refers to green tubes, upsetted tubes, drill pipe, threaded casing, threaded tubing and tool joints.

Conventionally, it is important to be able to control the inventory of such pipe during the formation of the upset and subsequent to the formation of the upset. Whenever "green pipe" is received and throughout the upsetting operation, a bar code is applied to the outer diameter of this green pipe. The pipe is identified and orientation numbered by applying a bar code for traceability purposes. This bar code is applied with either paint or by the application of a label onto the outer diameter of the pipe. Such a bar code can correspond to heat, lot, purchase order number and pipe description. Once this bar code is applied to the outer diameter of the pipe, the information regarding the pipe can be stored in the computer system of the upsetting factory. As such, inventory control can be effectively maintained by the factory. A particular length of tubular can be continually monitored throughout the manufacturing process.

Unfortunately, in the manufacturing of present tubular products or other related steel products, it is impossible to paint a barcode and numbers with paint that is able withstand the severe thermal shock at the heat treatment portion of the manufacturing processes. The heat treatment process during the manufacture of the tubular will encounter temperatures as high as 1800° F. This tubular is then water-quenched with up to 300 p.s.i. of water pressure or severe oil quenched. Such heat treatment and quenching activities are carried out in order for the tubular, or other related products, to reach the proper physical properties for usage. At present, nearly all tubular products that go to heat treatment are hand-stamped at one end by several employees. This often develops a problem in that numbers are not stamped correctly. As a result, there is a loss of traceability. This can create problems for inventory control, customers, tracking, traceability, accounting, loss of production and for the waste of man-hours in correcting these problems.

It is an object of the present invention to provide a method of marking a tubular that increases the ability to trace the tubular during the manufacturing process.

It is another object of the present invention to provide a method of marking a tubular which improves the efficiency of the manufacturing process.

It is a further object of the present invention to provide a method of marking a tubular that enhances inventory control in the manufacturing environment.

It is another object of the present invention to provide a method of marking a tubular that reduces costs associated with the marking of the tubular and enhances the profitability associated with the sale of such manufactured tubular.

It is another object of the present invention to provide a method of marking a tubular which reduces human error.

It is a further object of the present invention to provide a method of marking a tubular that enhances the productivity associated with the manufacture of the tubular.

It is another object of the present invention to provide a method of marking a tubular that allows for instant data collection during the manufacturing process.

It is still another object of the present invention to provide a method of marking a tubular that enhances the ability to accurately cost the labor associated with the manufacture of the tubular.

It is another object of the present invention to provide a method of marking a tubular that is relatively easy to implement.

It is another object of the present invention to provide a method of having a barcode marked on tool joint 35° that will have all information of manufacturing process and description of both tool joint and tubular product all transferred by computer network.

These and other objects and advantages of the present invention will become apparent from a reading of the attached specification and appended claims.

BRIEF SUMMARY OF THE INVENTION

The present invention is a method of marking a tubular that comprises the steps of: (1) applying an identification indicia onto the outer diameter of the tubular; (2) forming an indicator onto at least one of the ends of the tubular such that the indicator corresponds to information in the identification indicia; (3) heat treating the tubular such that the identification indicia is diminished; and (4) reapplying the identification indicia onto the outer diameter of the tubular based upon the indicator formed on the end of the tubular.

In the present invention, the identification indicia is preferably a bar code. This bar code can either be a 2D matrix bar code or a any other barcode symoblogy.

In the present invention, an upset is formed onto at least one of the ends of the tubular. The step of forming an indicator includes applying the indicator on an end face of the upset or, alternatively, applying the indicator on an outer diameter of the tubular adjacent the end of the upset. The indicator is formed of by either laser-engraving the indicator, stenciling the indicator, pin dotting the indicator, or by affixing a tag that has the indicator formed thereon onto the end of the upset.

The step of reapplying the identification indicia onto the outer diameter of the tubular includes scanning the end of the tubular after the step of heat treating so as to store information from the indicator, and applying the stored information as a bar code onto the outer diameter of the tubular. The step of heat treating includes heating the tubular to an austenitize temperature, and quenching the tubular after the step of heating. The step of reapply includes printing the identification information onto the outer diameter of the tubular between the ends the tubular.

The end of the tubular can be machined so as to remove the indicator therefrom. The step of machining occurs after the identification information is reapplied to the outer diameter of the tubular.

DETAILED DESCRIPTION OF THE INVENTION

Figure 1:
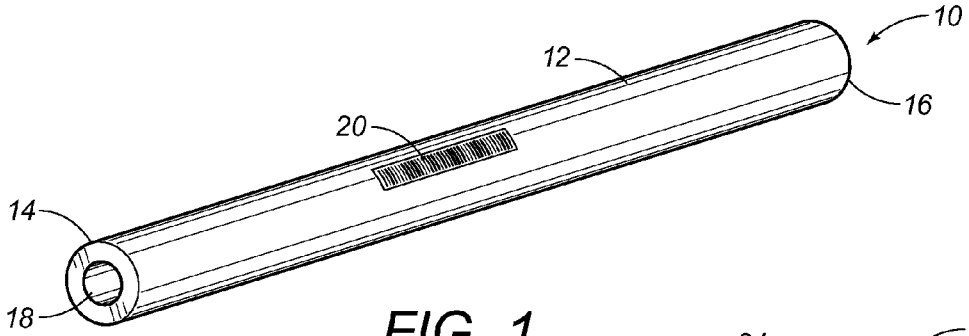
FIG. 1 is a perspective view showing a tubular having a bar code marked on an outer diameter thereof.

Referring to FIG. 1, there is shown the tubular 10. The identification indicia 20 is located generally centrally on the pipe 12 between the ends 14 and 16. This identification indicia 20 is a bar code which will contain information relating to the tubular 10. This information can be in the nature of heat numbers, lot, purchase order number, pipe description and pipe condition. The pipe description can be in the nature of describing the length of pipe 12, the diameter of pipe 12, the wall thickness of pipe 12 and the type of steel used for the pipe 12. Additionally, such identification indicia 20 can also be indicative of the manufacturer of the tubular 10, the location of the manufacturer, and other detailed information. The application of such the identification indicia 20 onto the outer diameter of the pipe 12 is presently carried out conventionally in manufacturing operations.

Figure 2:
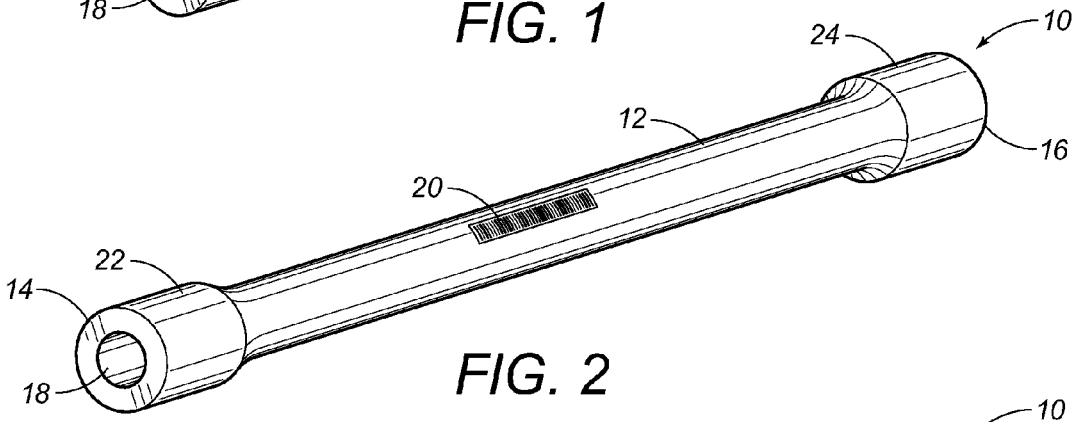
FIG. 2 shows the tubular of FIG. 1 as having upsets formed at opposite ends thereof.

In FIG. 2, it can be seen that the tubular 10 has a first upset 22 that is formed adjacent to the end 14 and an upset 24 that is formed adjacent to the end 16 of pipe 12. The upsets 22 and 24 are formed in a conventional upset forming process. The upsets 22 and 24 have a greater wall thickness and serve to form connectors for joining the tubular 10 to an adjacent tubular. The identification indicia 20 remains on the outer diameter of the pipe 12 generally centrally between the ends 14 and 16.

Figure 3:
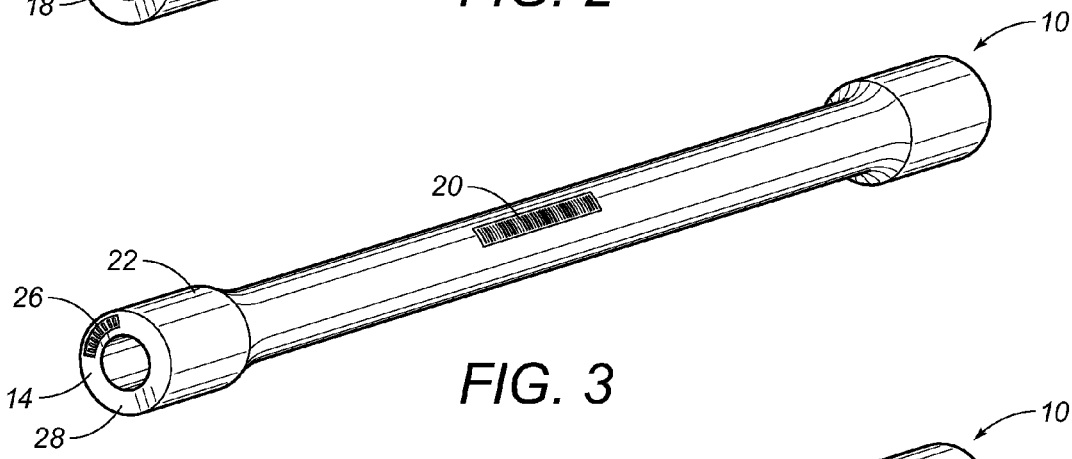
FIG. 3 shows a subsequent step of the method of the present invention in which the indicator is placed onto an end face of an upset at one end of the tubular.

In FIG. 3, the tubular 10 enters another stage in accordance with the method of the present invention. The information from the identification indicia 20 is now formed as an indicator 26 on the end face 28 at the end 14 of the upset 22. The indicator 26 contains information which corresponds to the information from the identification indicia 20. The indicator 26 can be laser engraved, plasma sprayed, stenciled, pin dotted, scribed or otherwise engraved onto the end face 28. Alternatively, the indicator 26 can be in the form of a metal tag that has the indicator information imprinted or formed thereon. The metal tag can then be tack welded or otherwise secured onto the end face 28 of the tubular 10.

Figure 4:
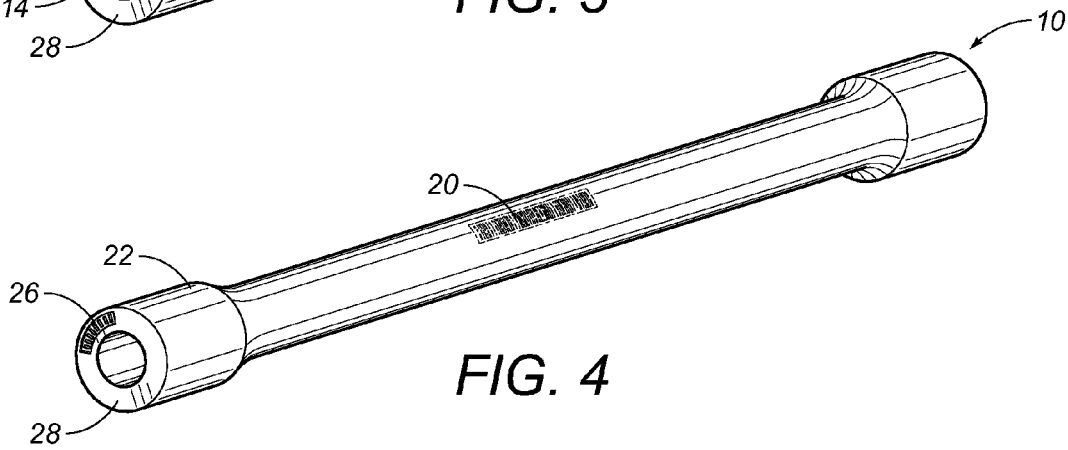
FIG. 4 illustrates the tubular after the process of heat treating in which the identification indicia is diminished.

In FIG. 4, the tubular 10 is illustrated after being subjected to heat treatment processes. As can be seen in FIG. 4, the identification indicia 20 has been diminished as a result of the heat treating process. As used herein, the term "diminished" means that the bar code associated with the identification indicia 20 is no longer readable or, at least, quite difficult to read. Since typical bar codes associated with the identification indicia 20 cannot withstand the high temperatures and quenching process associated with heat treating, such a identification indicia 20 will inevitably become damaged. As a result, it is not easy to read or receive information from the diminished identification indicia 20. Fortunately, however, the indicator 26 still remains intact on the end face 28 of the upset 22. Unlike prior art process, the indicator 26 is dot pin or pin dotted using computer processes. In other words, in order to apply the indicator 26, it is only necessary to scan the bar code associated with the identification indicia 20 and program the computer so as to dot pin or pin dotted the indicator 26 on the end face 28. In this manner the indicator 26 will withstand the heat treatment and quenching processes associated with the manufacture of the tubular 10.

Figure 5:
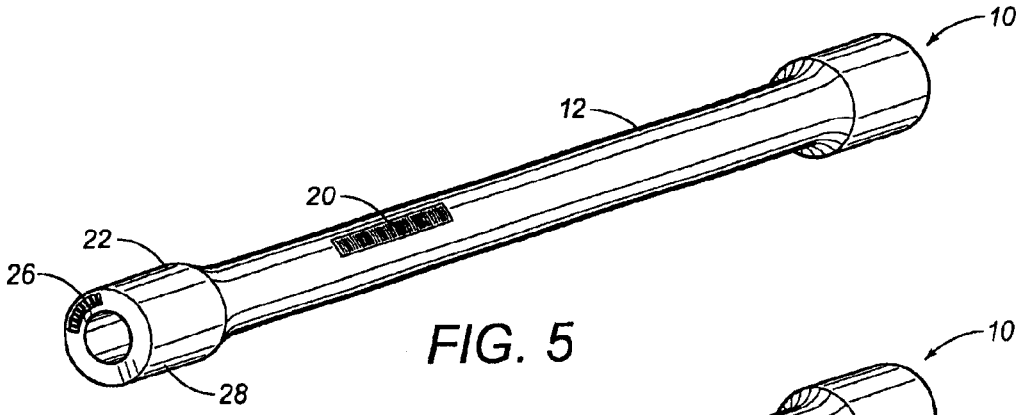
FIG. 5 illustrates a further subsequent step of the process of the present invention in which the identification indicia is reapplied onto the outer diameter of the tubular.

FIG. 5 illustrates the process the present invention after the heat treatment processes. As can be seen, the identification indicia 20 has been reapplied onto the outer diameter of the pipe 12 of tubular 10. The bar code of identification indicia 20 is easily applied by reading the information on the indicator 26 at end face 28 of upset 22. The bar code 20 can be reapplied by painting, labeling or other techniques described herein above.

Figure 6:
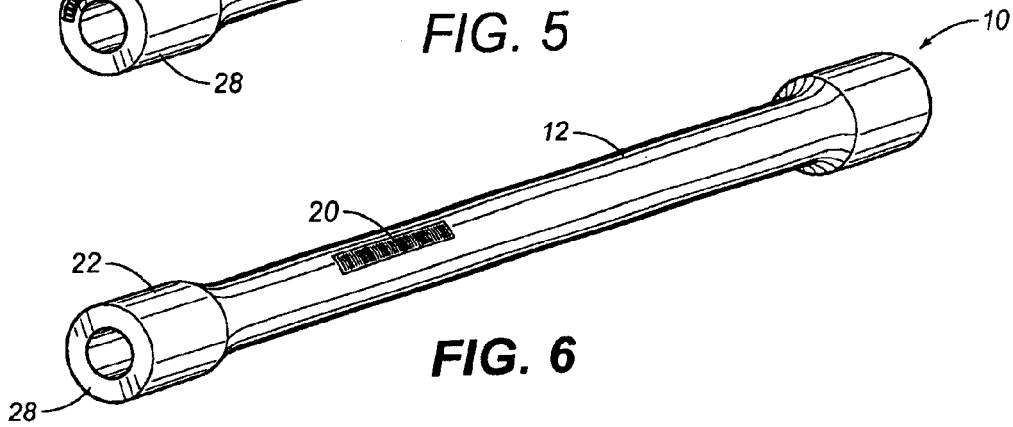
FIG. 6 shows a final step of the method of the present invention in which the end of the upset of the tubular is machined such that the indicator is removed therefrom.

In FIG. 6, the upset 22 of tubular 10 has been subjected to additional machining processes. Conventionally, after forming the upset 22 and during the machining to the tubular 10, the indicator 26 is machined off the end face 28 of upset 22. Since the bar code associated with identification indicia 20 remains, the tubular 10 can continue to be identified throughout the manufacturing process.

Figure 7:
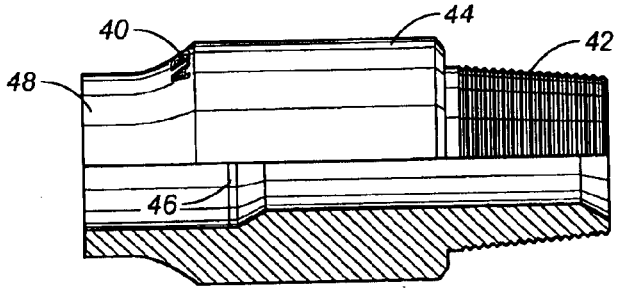
FIG. 7 shows an alternative step of the method of the present invention in which the indicator is formed on a 35° taper area of a threaded connection of the tubular.

FIG. 7 shows the application of the indicator 40 onto the 35° taper area of tool joint 44. As used herein, the tool joint 44 is a "tubular" onto which the indicator 40 can be applied. The indicator 40 is applied adjacent to the end 48 of the tool joint 44. The opposite end 42 is a threaded connection that extends outwardly from the body 46 of tool joint 44. The indicator 40 should have information corresponding to the identification indicia formed on the body 46 of tool joint 44. The indicator 40 is in the form of pin dotting.

Figure 8:
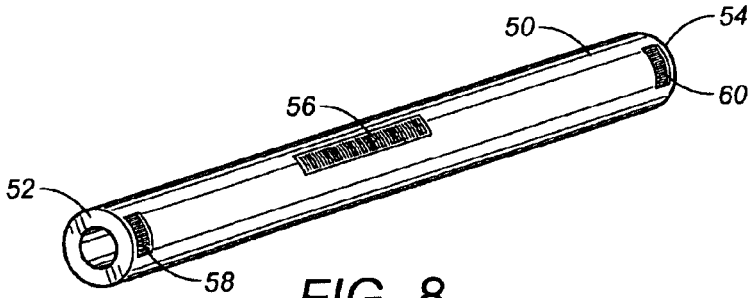
FIG. 8 is a perspective view of an alternative form of the present invention in which the indicator is placed on the outer diameter of the tubular adjacent to each of the opposite ends of the tubular.

FIG. 8 shows that the process of the present invention is equally applicable to a straight tubular product such as tubular 50. Tubular 50 has a first end 52 and a second end 54. The identification indicia 56 is formed on the outer diameter of the tubular 50 between the ends 52 and 54. The indicator 58 is formed adjacent to the end 52 but on the outer diameter of the tubular 50 adjacent to the end 52. Indicator 60 is formed on the outer diameter of the tubular 50 adjacent to the end 54. The application of the indicators 58 and 60 on the outer diameter of the tubular 50 can also be incorporated into the forming of the upsets on the tubular. Within the concept of the present invention, the indicators can be formed on either the end face of the upsets or on the outer diameter of the tubular adjacent to such end faces.

The present invention is particularly applicable, but not limited to, to the entire process of bar coding the tubular upset pipe. In conventional processes, the "green pipe" is delivered to the factory. The pipe is identified and numbered by applying a bar code for traceability purposes with paint or a label on the outer diameter thereof. The pipe is inspected by scanning the outer diameter of the pipe. The pipe is stored prior to the step of upsetting. During the upsetting process, pipe is loaded on an incoming upsetter rack so as to upset one end and scan the outer diameter thereof. The pipe is then preheated. Ultimately, the pipe is heated to the upsetting temperature while the outer diameter of the pipe is suitably scanned. The upsets are then formed on the pipe. The upset is then properly inspected. The pipe is then turned around and loaded on an incoming upsetter rack for upsetting the second end of the pipe. Once again, the second end of the pipe is preheated and then heated to the upsetting temperature. After forming the upset, the pipe is then stored so as to be ready for heat treatment.

During the storing of the pipe, the bar code information from the outside diameter of the tubular can be transferred as a bar code to one end or both ends of the upsetted pipe, this is carried out by a computer network. The bar code is applied by laser, stencil, pin dot, metal tag, scribing or any other type of permanent marking or engraved markings at both or one end of the tubular pipe. The tubular pipe is then loaded on an incoming rack for heat treatment. The end of the pipe is scanned before entering the austenitize furnace. The end of the pipe, with its markings, may be scanned after heat treatment. The end of the pipe may be further scanned before entering a tempering furnace. This end of the pipe may be further scanned after the tempering operation. Ultimately, the pipe is then stored.

After this storage of the pipe after heat treatment, the bar code information from one end or both ends of the tubular product is transferred to the outer diameter of the tubular by printing a bar code with paint and with the same product information from the end of the tubular product bar code by using a computer network. The outer diameter of the pipe can then be scanned and stored.

After storing, the pipe can be loaded on an incoming rack for machining the inside and outside diameters at the face of the pipe. As a result, the bar code markings on the ends of the tubular product are thereby removed. After the bar code on the ends of the tubular product are removed, the pipe is scanned on the outer diameter alone during the remaining processes of forming the tubular.

The paint used for the formation of the bar code of the identification indicia 20 should be printed with a paint that is able to withstand temperatures of up to 900° F. This will withstand the temperatures that occur during the internal coating that is baked onto the tubular 10 products and the temperatures associated with the heat experienced by the tubular during drilling activities.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A method of marking a tubular comprising:

applying an identification indicia onto the outer diameter of the tubular, the tubular having a first end and a second end;

forming an indicator onto at least one of said first end and said second end, said indicator corresponding to information in said identification indicia;

heat treating the tubular such that said identification indicia is diminished; and reapplying the identification indicia onto said outer diameter of the tubular based upon the indicator formed on the end of the tubular.

2. The method of claim 1, said identification indicia being a bar code.

3. The method of claim 2, said bar code selected from the group consisting of a 2D matrix bar bode and a UPC bar code.

4. The method of claim 1, further comprising:

forming an upset onto at least one of said first and second ends.

5. The method of claim 4, said step of forming an indicator comprising:

applying said indicator on an end face of said tubular.

6. The method of claim 1, said set of forming said indicator comprising:

applying said indicator on an outer diameter of the tubular adjacent the end of the tubular.

7. The method of claim 1, said step of forming an indicator comprising:

laser engraving in said indicator onto the end of said tubular.

8. The method of claim method of claim 1, said step of forming an indicator comprising:

stenciling said indicator onto the end of said tubular.

9. The method of claim 1, said step of forming an indicator comprising:

pin dotting said indicator onto the end face of said tubular.

10. The method of claim 1, said step of forming an indicator comprising:

affixing a tag onto the end of said tubular, said tag having said indicator formed thereon.

11. The method of claim 1, said step of reapplying comprising:

scanning the end of said tubular after said step of heat treating so as to store information from said indicator; and applying the stored information as a bar code onto said outer diameter of the tubular.

12. The method of claim 1, said step of heat treating comprising:

heating the tubular to a temperature of greater than 900° F.; and quenching the tubular after the step of heating.

13. The method of claim 1, said step of reapplying comprising:

printing the identification information onto said outer diameter of said tubular between said first and second ends thereof.

14. The method of claim 1, further comprising:

machining the end of the tubular so as to remove the indicator therefrom.

15. The method of claim 14, said step of machining occurring after the identification information is reapplied to said outer diameter of the tubular.

16. The method of claim 1, said tubular being a tool joint, said step of forming an indicator comprising applying said indicator to a 35° tapered of said tool joint.

17. A method of manufacturing a tubular comprising:

forming the tubular so as to have an upset on at least one end thereof;

applying an identification indicia onto an outer diameter of the tubular in an area between the ends of the tubular;

forming an indicator onto said upset, said indicator corresponding to information in said identification indicia;

heat treating the tubular such that said identification indicia is diminished; and reapplying the identification indicia onto said outer diameter of the tubular based upon the indicator formed on the upset.

18. The method of claim 17, said step of forming an indicator comprising:

applying said indicator onto an end face of said upset.

19. The method of claim 17, said step of forming said indicator comprising:

applying said indicator onto an outer diameter of said tubular adjacent to the end of said upset.

20. The method of claim 17, machining the end of the upset of the tubular so as to remove the indicator therefrom, said step of machining occurring after the identification indicia is reapplied to said outer diameter of the tubular.

21. The method of claim 17, said step of reapplying comprising:

scanning the end of the upset of the tubular after said step of heat treating so as to store information from said indicator; and applying the stored information as a bar code onto said outer diameter of the tubular.

* * * * *